US005154146A

United States Patent [19]

Hagerman et al.

[11] Patent Number: 5,154,146

[45] Date of Patent: Oct. 13, 1992

[54] COMPOSITE VALVE-TRAIN PUSHROD

[75] Inventors: Edward M. Hagerman, Royal Oak; Richard P. Atkins, Utica, both of Mich.

[73] Assignee: General Motors Corporation, Detroit, Mich.

[21] Appl. No.: 753,130

[22] Filed: Aug. 30, 1991

[51] Int. Cl.[5] ..... F01L 1/14

[52] U.S. Cl. ..... 123/90.61

[58] Field of Search ..... 123/90.61, 90.62, 90.63, 123/90.64; 74/579 E, 579 R

[56] References Cited

U.S. PATENT DOCUMENTS

| | | | |
|---|---|---|---|
| 2,857,895 | 10/1958 | Scheibe | 123/90.61 |
| 3,964,455 | 6/1976 | Brown | 123/90.62 |
| 4,186,696 | 2/1980 | Linsenmann | 123/90.61 |
| 4,218,996 | 8/1980 | Usuj | 123/90.61 |
| 4,296,060 | 10/1981 | Killmeyer et al. | 264/137 |
| 4,453,505 | 6/1984 | Holtzberg et al. | 123/90.61 |

FOREIGN PATENT DOCUMENTS

| | | | |
|---|---|---|---|
| 13204 | 1/1982 | Japan | 123/90.61 |
| 155516 | 9/1984 | Japan | 123/90.61 |
| 1343983 | 1/1974 | United Kingdom | 123/90.61 |

OTHER PUBLICATIONS

Shell Chemical Company, Technical Bulletin, SC: 712-88, "Epon Resin, 9310" Dec. 1988.

Lubin et al., Handbook of Composites, Van Nostrand Reinhold Co. Inc. 1982, at chapter 17.

*Primary Examiner*—E. Rollins Cross

*Assistant Examiner*—Weilun Lo

*Attorney, Agent, or Firm*—Randy W. Tung

[57] ABSTRACT

An engine valve-train pushrod of composite material construction and a process of manufacturing the same. The pushrod is an elongate, hollow rod of epoxy resin and fibers. The fibers consist essentially of graphite, glass or a combination thereof. Endcaps are secured internally to each end of the elongate hollow rods.

6 Claims, 1 Drawing Sheet

COMPOSITE VALVE-TRAIN PUSHROD

FIELD OF THE INVENTION

This invention relates to push rods for a valve-train of an engine, and particularly, pushrods formed of composite materials, and a method of making the same.

BACKGROUND OF THE INVENTION

There is a continuing need to lighten and strength motor vehicles and aircraft to improve fuel economy. As a result, structural members and other parts are being constructed from lighter materials. In the case of valve-train parts, weight reduction also helps to overcome inertia to achieve rapid movement of parts during engine operation.

The operation of an internal combustion engine requires that an explosive mixture of gasoline and air be delivered to a combustion zone of a cylinder during an interval timed to the intake stroke. After combustion, the products of the combustion are removed during an exhaust stroke. Intake and exhaust are accomplished by the operation of poppet valves with at least one intake valve and one exhaust valve. The opening and closing of intake and exhaust ports are affects by the rate at which the valve components operate. The timing is controlled by a camshaft driven from the engine's crankshaft.

In traditional engines, the oscillation defined by the cam profile is transferred through a valve-lifer, pushrod, and rocker arm to the valve. The masses of the components of the valve-train govern the precision of the valve timing by defining, through inertial loading factors, the accelerations attainable. Valve-trains of a minimum mass are, therefore, very desirable. Certain engine designs have minimized mass by reducing the number of valve-train components through the use of single and double overhead cams. While the overhead cam designs are effective they tend to be mechanically more complex.

Composite materials are used to achieve strength and weight reduction features not present in a single material. Composite rods are produced in limited quantities, in a labor-intensive, partially manual process, one at a time, for high performance race cars. The process used is a prepreg process where a reinforcing fiber mat coated with a resin is wrapped around a mandrel and cured to form a rod. Exterior endcaps are then secured to the exterior of the rod at each end. This process is slow, inefficient, costly and unsuitable for mass production.

Therefore, what is needed is a valve-train pushrod which is light weight, stable at high temperatures, strong, resistant to buckling, stiff, suitable for use in engines at high temperatures, and a method of manufacture which is suitable for mass production.

SUMMARY OF THE INVENTION

A new composite pushrod and method of making it are provided. The preferred pushrod basically includes an elongate, hollow rod of a composite material which is a mixture of epoxy resin and fibers. First and second endcaps are secured adjacent respective ends of the rod. The first endcap has a head portion adapted to engine a valve-lifter. The second endcap has ahead portion adapted to engage a connector secured to a rocker arm. Each of endcaps has a depending shank portion received within one of the ends of the hollow rod, and secured therein by securing means, preferably an adhesive.

The resin is a thermoset epoxy resin with a glass transition temperature of at least about 150 degrees Centigrade. Preferably, the thermoset epoxy resin is a thermoset polymer suitable for a pultrusion process, which possesses thermal resistance sufficient for the pushrod application, that is, suitable for use in an engine at temperatures of about 110 degrees Centigrade to about 130 degrees Centigrade.

To achieve strength, low weight and wear resistance, the fibers are optionally all graphite, all glass or a 50/50 mixture of graphite and glass.

In a preferred method, pushrods of the invention are formed by first coating fiber strands with the thermoset epoxy resin, and then pulling the resin coated fiber stands through a shaping and forming heated die to form a continuous length of shaped, hollow, rod structure. The heated die at least partially cures the hollow rod structure while maintaining the shape of the continuous, hollow, rod structure. Then, the continuous, hollow, rod structure is cut into individual hollow rods of desired length using a diamond impregnated cutting wheel.

The shank portions of steel endcaps are inserted into, respectively, the first and second ends of the hollow rod and secured therein by the preferred adhesive.

In a final step, the hollow rod is heated for a time and at a temperature sufficient to cure the adhesive and complete the cure of the epoxy resin.

Advantages of the invention including these and other objects, features and advantages will become apparent from the following description of the preferred embodiments, appended claims and accompanying drawings.

DETAILED DESCRIPTION OF THE PREFERRED EMBODIMENTS

Figure 1:
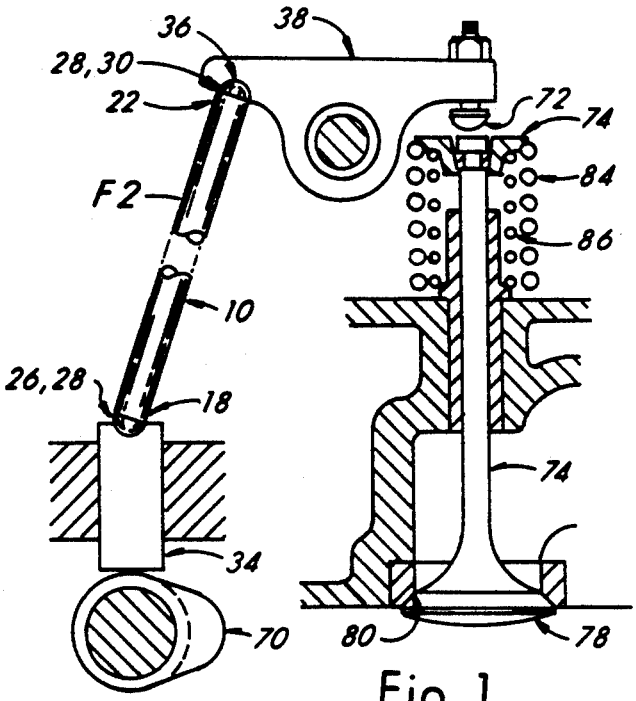
FIG. 1 is a fragmentary sectional view of a portion of engine valve-train components including the pushrod of the invention.
Figure 2:
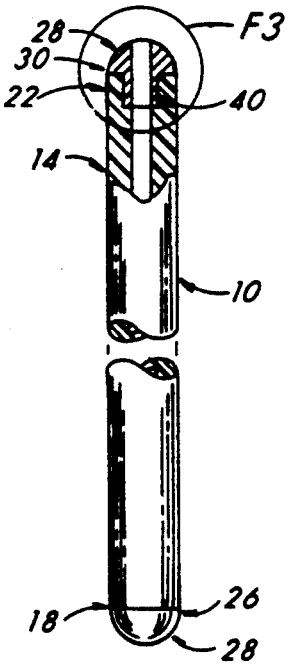
FIG. 2 is an elevational view, partially in section, of the pushrod shown in FIG. 1.
Figure 3:
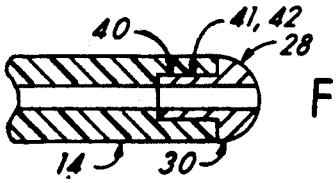
FIG. 3 is an axial cross-sectional view of the encircled portion of FIG. 2.

In a preferred embodiment, a composite pushrod 10 of the invention as shown in FIGS. 1-3, comprises an elongate, hollow rod 14 of a composite material, preferably, essentially of epoxy resin and fibers. The rod 14 has first and second ends 18, 22 with first and second endcaps 26, 30 secured adjacent respective ends 18, 222 of the rod 14. The first endcap 26 has a head portion 28 adapted to engage a valve-lifter 34. The head portion 28 of the second endcap 30 is adapted to engage a connector 36 secured to a rocker arm 38. The endcaps 26, 30 each have a depending shank portion 40 received within respective ends 18, 22 of the hollow rod 14 and secured therein by securing means 41, preferably an adhesive 42.

In order to provide wear resistance and minimize weight, the endcaps 26, 30 are of steel and secured within the interior of respective ends 18, 22 of the hollow rod 14 by an adhesive 42. Thus, the endcaps are preferred interior endcaps and the adhesive 42 is, preferably, a mixture of epoxy compositions and a curing agent as further described below.

The endcaps 26, 30 may be essentially identical so that both ends 18, 22 of the assembled pushrod 10 are essentially identical. Alternatively, endcaps 26, 30 may have respective head portions 28*a*, 28*b* (not shown), which differ from one another. FIG. 3 shows the detail of endcap 30 received in end 22 of rod 14, and this detailed end is similar to end 18 and endcap 26. In this embodiment, the head portion 28 of endcaps 26, 30 are thus essentially identical.

To achieve high strength, low weight, wear resistance, and low cost, the fibers are optionally all graphite, all glass or a 50/50 mixture of graphite and glass.

Commercially available fiber products, sized for epoxy matrix, were used. For example, the graphite is available from Michigan Fabricators and the same vendor supplies a 50/50 mixture of glass and graphite. The glass fibers are available from Shell Development Laboratories.

The resin is a thermoset epoxy resin with a glass transition temperature of at least about 150 degrees Centigrade. Preferably, the thermoset epoxy resin is a thermoset polymer suitable for a pultrusion process, which possesses thermal resistance sufficient for the pushrod application, that is, suitable for sue in an engine at temperatures of about 100 degrees Centigrade to about 130 degrees Centigrade.

An example of the epoxy resin is Shell Chemical's epoxy pultrusioners in 9130. The 9130 system has a reported glass transition temperature, Tg, of about 150 degrees Centigrade to about 170 degrees Centigrade which is adequate for the temperature requirements of the application, normally about 110 degrees Centigrade to about 139 degrees Centrigrade.

Figure 4:
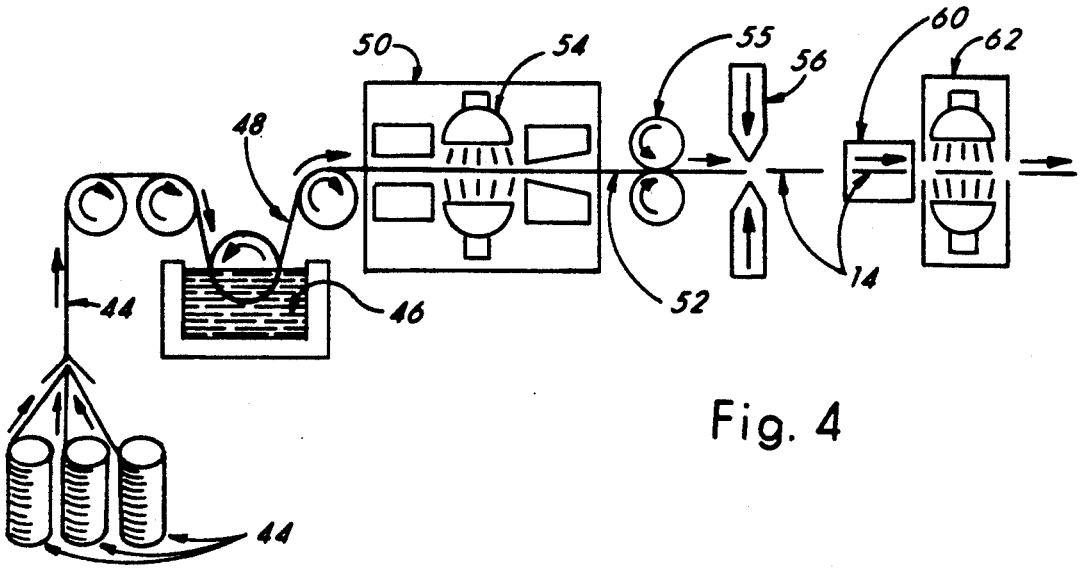
FIG. 4 is a diagrammatic view of a preferred process for forming the pushrod shown in FIGS. 1-3.

From the materials described above, composite pushrods were prepared in a process, as shown in FIG. 4, by first coating fiber strands 44 with the thermoset epoxy resin 46. And then, pulling the resin coated fiber strands 48 through a shaping and forming heated die 50 to form a continuous length of shaped, hollow, rod structure 52. The heated die 50, heated by heater 54, at least partially cures the hollow rod structure 50, while in-line pulling means 55 maintains the shape of the continuous, hollow, rod structure 52. The major portion of the cure occurs in the shaping and forming die 50. The temperature of the die 50 is mainly a function of pulling speed. Then the continuous, hollow, rod structure 52 is cut into individual hollow rods 14 of desired length using a diamond impregnated cutting wheel 56.

To complete formation of the pushrod 10 the shank portions 40 of steel endcaps 26, 30 are inserted into, respectively, the first and the second ends 18, 22 of the hollow rod 14 and secured therein by the adhesive 42 at station 60. Finally, the rod 10 is heated by heating means 62 for a time and at a temperature sufficient to essentially completely cure the adhesive 42 and the epoxy resin 46. Desirably, this heating step is at a temperature of at least about 80 degrees Centigrade. Preferably, heating occurs in two stages. In a first stage, heating occurs at a temperature of at leas about 80 degrees Centigrade for about one hour, followed by a second stage of heating at a temperature of at least about 200 degrees Centigrade for about three hours.

In use, the pushrod 10 of the invention is disposed between the valve-lifter 34 and a rocker arm 38. A cam 70 moves the valve-lifter 34 which moves the pushrod 10. The pushrod 10, in turn moves the rocker arm 38 which has a tappet 72 which moves valve-stem assembly 74, causing valve-heat 78 to move away from valve-seat 80, thus providing an opening into a cylinder of an engine (not shown). The irregular shape of cam 70 permits movement by pushrod 10, valve-stem assembly 74, and valve-head 78 in an opposite direction, when springs 84, 86 causing valve-head 78 to be urged against seat 80, thus providing closure of the opening of the cylinder.

EXAMPLE 1

Pushrods 10 were formed by the method of the invention using the pultrusion procedure, as shown in FIG. 4, and described above. Rods were produced by coating strands of fibers with Shell Company's 9130 thermoset epoxy resin. Three types of rod structures 52 were produced using, respectively, glass fiber strands from Shell Development and graphite fiber strands and 50/50 graphite and glass fiber strands from Michigan Fabricators. Each of the rod structures 52 were cut using a diamond-impregnated cut-off wheel 56, to 131 mm and 219 mm lengths for use in a 2.8 L/V6 and 2.5 L four cylinder engines.

The cut lengths of rod 14 were then fitted with internal endcaps 26, 30 at ends 18, 22 thereof, held in place by a special adhesive formulation 42. The adhesive formulation 42 is described in Table I. The adhesive 42 was conveniently applied to the shanks 40 of each endcap 26, 30 prior to insertion into the ends 18, 22 of the rod. The adhesive 42 was cured by oven heating for at least one hour, at a temperature of at lest about 80 degrees Centigrade, followed by at least three hours at a temperature of at least about 200 degrees Centigrade. This heating cycle also acted as a post cure step for the epoxy component of the pultruded rods 14.

TABLE I

| Pushrod Tip Adhesive Formulation | | | |
|---|---|---|---|
| Component | Trade Name | Concentration | Supplier |
| Epoxy | Araldrite 0510 | 100 parts | Ciba Geigy |
| Epoxy | Araldrite MY720 | 100 parts | Ciba Geigy |
| Curing Agent (Imidazole Type) | AP 5 | 8 parts | Archem |
| Thickener | Cabosil | 8 parts | Cabot Corp |

The resulting pushrods 10 were tested on an Instron Univseral Tester using a fixture which duplicated the compression loading experienced in an engine. A cross-head speed of $5\times10^{-3}$ meters per minute were used. From the resulting stress/strain curves two properties were determined. The first was the critical buckling strength, or the maximum compression load recorded, and the second was the effective stiffness, measured by the slope of the stress/strain curve. The test results are shown in Table II along with the values for the conventional steel parts.

TABLE II

| | | Pushrod Properties | | |
|---|---|---|---|---|
| Material | Length mm | Stiffness N/M $\times 10^6$ | Strength N $\times 10^4$ | Weight g |
| Glass/Epoxy | 140 | 9.5(−14%)(a) | 1.42(+73%)(a) | 14(−61%)(a) |
| Hybrid/Epoxy(b) | 140 | 15.6(+40%) | 1.57(+91%) | 11(−69%) |

TABLE II-continued

| Material | Length mm | Pushrod Properties Stiffness N/M × $10^6$ | Strength N × $10^4$ | Weight g |
|---|---|---|---|---|
| Graphite/Epoxy | 140 | 18.5(+67%) | 1.76(+115%) | 10(−72%) |
| Steel(c) | 140 | 11.1 | 0.82 | 36 |
| Glass/Epoxy | 228 | 6.5(−40%) | 0.42(−58%) | 22(−59%) |
| Hybrid/Epoxy(b) | 228 | 10.5(−5%) | 0.66(−34%) | 16(−70%) |
| Graphite/Epoxy | 228 | 13.7(+24%) | 0.96(−4%) | 15(−72%) |
| Steel(c) | 228 | 11.0 | 1.00 | 54 |

(a) = Value in parenthesis is property in % relative to steel
(b) = Hybrid designated 50% glass, 50% graphite
(c) = comparative pushrods of traditional steel composition/construction To demonstrate the durability of the pushrod 10, an engine set (12) of 140 mm glass/epoxy pushrods 10 was prepared and installed in a developmental 2.8 L/V6 engine. The engine was run on a dynamometer test cycle for 600 hours. The engine was then installed in a vehicle and over a three year period 95,000 miles were accumulated. This was all accomplished without failure of pushrod 10. A set of five representative pushrods 10 from this engine test was examined in the Instron test described above to determine if degradation of any property had occurred as a result of long-term fatigue. The average values obtained were $1.39\times10^4$ N strength, and $9.9\times10^6$ N/m stiffness, both within experimental error of the original values.

EXAMPLE 2

As a further demonstration of durability, an engine set (16) of 181 mm graphite-epoxy pushrods was prepared as described in Example 2 above, and installed in a 5.7 L/V8 engine and tested on a dynamometer durability cycle consisting of wide open throttle cycling between peak torque and 200 RPM over maximum horsepower. The pushrod 10 have complete 660 hours of this cycling, again without failure.

Graphite/epoxy pushrods of 228 mm length for use in an engine, were prepared as in Example 1, except the rods were cut using a carbide tipped band saw. The engine containing these parts was installed in a vehicle and tested. After 50 miles of operation of pushrod failure was experienced. The composite rods had cracked longitudinally in the fiber orientation direction allowing the steel endcap to separate. This example demonstrated the critical nature of the cutting or cut surface of the rod ends. The use of the recommended diamond impregnated cut-off wheel eliminates chipping and cracking damage to the rod ends which severely compromises the durability of the pushrods.

The results clearly show that the pushrods 10 of the invention are satisfactory replacements for steel pushrods currently used in vehicle engines. The pushrods 10 of the invention are durable, light weight, economical, and suitable for continuous, automated mass production.

While this invention has been described in terms of certain embodiments thereof, it is not intended that it be limited to the above description, but rather only to the extent set forth in the following claims.

The embodiments of the invention in which an exclusive property or privilege is claimed are defined in the appended claims.

We claim:

1. A composite pushrod for use in an engine comprising:

a) an elongate, hollow rod of a composite material consisting of a single ply of epoxy resin and continuous unidirectional, said fibers being oriented in a direction substantially parallel to the longitudinal axis of said hollow rod;

b) first and second endcaps secured adjacent respective ends of the rod, the first endcap with ahead portion adapted to engage a valve-lifter assembly, the second endcap with a head portion adapted to engage a rocker arm assembly;

c) each of the endcaps having a depending shank portion received within one of the ends of the hollow rod;

d) securing means retaining the shank portion in the hollow end of the rod;

e) the resin being selected from the group consisting of thermoset epoxy resins with a glass transition temperature of at least 150 degrees Centigrade; and f) the fibers being at least one selected from the group consisting of glass and graphite.

2. A pushrod as in claim 1, wherein the endcaps are of steel.

3. A pushrod as in claim 1, wherein the fibers consist essentially of the graphite.

4. A pushrod as in claim 1, wherein the fibers consisting essentially of the glass.

5. A pushrod as in claim 1, wherein the fibers consist essentially of a mixture of the graphite and the glass.

6. A pushrod as in claim 1, wherein the securing means is an epoxy adhesive which cures upon being heated.

* * * * *